US007640972B2

(12) United States Patent
Maupetit et al.

(10) Patent No.: US 7,640,972 B2
(45) Date of Patent: Jan. 5, 2010

(54) SPIRAL HEAT EXCHANGER

(75) Inventors: Philippe Maupetit, Arbourse (FR); Pierre Martinez, Marzy (FR); Boualem Oudjedi, Nevers (FR)

(73) Assignee: Alfa Laval Corporate AB, Lund (SE)

( * ) Notice: Subject to any disclaimer, the term of this patent is extended or adjusted under 35 U.S.C. 154(b) by 783 days.

(21) Appl. No.: 10/556,526

(22) PCT Filed: May 11, 2004

(86) PCT No.: PCT/SE2004/000722

§ 371 (c)(1),
(2), (4) Date: Jun. 16, 2006

(87) PCT Pub. No.: WO2004/102101

PCT Pub. Date: Nov. 25, 2004

(65) Prior Publication Data

US 2007/0062680 A1 Mar. 22, 2007

(30) Foreign Application Priority Data

May 15, 2003 (SE) ..... 0301407-3

(51) Int. Cl.
*F28D 7/04* (2009.01)

(52) U.S. Cl. ..... 165/164; 165/178; 165/DIG. 398

(58) Field of Classification Search ..... 165/164, 165/165, 178, DIG. 398
See application file for complete search history.

(56) References Cited

U.S. PATENT DOCUMENTS 1,930,879 A 10/1933 Linderoth et al.
1,956,133 A * 4/1934 Rosenblad ..... 165/164
2,011,201 A * 8/1935 Rosenblad ..... 165/165
2,131,265 A * 9/1938 Bichowsky ..... 165/165
2,136,153 A * 11/1938 Rosenblad ..... 165/165
2,142,679 A 1/1939 Seifert
3,323,587 A * 6/1967 Lowell ..... 165/DIG. 398
3,705,618 A * 12/1972 Jouet et al. ..... 165/DIG. 398
3,921,713 A * 11/1975 Schnitzer et al. ..... 165/164
3,972,370 A * 8/1976 Malaval ..... 165/164
4,546,826 A * 10/1985 Zitzmann ..... 165/164

FOREIGN PATENT DOCUMENTS

CH 539 257 8/1973
CH 539 627 9/1973
DE 3925795 A1 * 2/1991 ..... 165/165
GB 501 389 2/1939
GB 745 914 3/1956
SE 112 656 12/1944

* cited by examiner

*Primary Examiner*—Leonard R Leo
(74) *Attorney, Agent, or Firm*—Fish & Richardson P.C.

(57) ABSTRACT

The invention relates to a spiral heat exchanger including a central cylinder (5) and at least two spiral sheets (6, 7). The sheets extend from the cylinder to form a first spiral-shaped flow channel (8) for a first medium and a second spiral-shaped flow channel (9) for a second medium. The cylinder forms an inner space within the cylinder. The cylinder includes a first opening (11) communicating with the first flow channel and a second opening (12) communicating with the second flow channel. A pipe (14) extends into the inner space of the cylinder. A first communication channel, communicating with the first flow channel via the first opening, is formed within the pipe. A second communication channel, communicating with the second flow channel via the second opening, is formed in the inner space outside the pipe.

16 Claims, 3 Drawing Sheets

SPIRAL HEAT EXCHANGER

BACKGROUND OF THE INVENTION AND PRIOR ART

The present invention refers generally to spiral heat exchangers for various purposes. More specifically, the invention refers to a spiral heat exchanger for recovering heat from problematic fluids, such as sludge. In particular, the present invention refers to a spiral heat exchanger including a central cylinder and at least two spiral sheets extending from the cylinder along a respective spiral-shaped path around a common center axis and forming at least a first spiral-shaped flow channel for a first medium and a second spiral-shaped flow channel for a second medium, wherein the cylinder extends around the center axis and forms an inner space within the cylinder, and wherein the cylinder includes a front end, a rear end, at least a first lateral opening communicating with the first flow channel and at least a second lateral opening communicating with the second flow channel.

Such a spiral heat exchanger is disclosed in SE 112 656. This document discloses one embodiment comprising a central cylinder. The cylinder is formed in one piece with an end plate. Two separate headers are provided in the inner space of the cylinder for the fluid communication with a respective spiral flow channel.

Conventionally, spiral heat exchangers are manufactured by means of a winding operation. The two sheets are welded together at a respective end, wherein the welded joint will be comprised in a center portion of the sheets. Alternatively, one single sheet is used for the manufacturing of the heat exchanger. Distance members, having a height corresponding to the width of the flow channels, are attached to the sheets. Before being wound, the center portion of the sheet or sheets is introduced into a gap of a retractable mandrel. Then the mandrel is rotated, wherein the sheets are wound to form the spiral element of the sheets. After retraction of the mandrel, two inlet/outlet channels are formed in the center of the spiral element. The two channels are separated from each other by the center portion of the sheets. The side ends of the spiral element are processed, wherein the spiral flow channels may be laterally closed at the two side ends in various ways. Typically, a cover is attached to each of the ends. One of the covers may include two connection pipes extending into the center and communicating with a respective one of the two flow channels. At the radial outer ends of the spiral flow channels a respective header is welded to form an outlet/inlet member to the respective flow channel.

One problem with this conventional spiral heat exchanger is the relatively complex manufacturing work needed for the mounting of the connection pipes extending from the center of the spiral heat exchanger. In particularly, the problem is related to the difficulty to achieve a proper and desired position for the two connection pipes and the headers at the periphery of the spiral element. It is frequently important that the headers are located at the top of the spiral element, and also that the connection pipes are positioned along a vertical plane. Furthermore, in case of a heat exchanger designed for receiving sludge as one of the media, it is also important that one connection pipe forming the sludge outlet is located beneath the other connection pipe forming a water inlet. These requirements imply that the center portion should be at least approximately horizontal. In order to obtain such a position of the connection pipes, the outer ends of the sheets frequently need to be cut after the winding operation.

CH 539 257 discloses another spiral heat exchanger element which is mounted in a cylindrical vessel. The heat exchanger element includes a central cylinder and two spiral sheets extending from the cylinder along a respective spiral-shaped path around a center axis. The spiral sheets form a first spiral-shaped flow channel for a first medium and a second spiral-shaped flow channel for a second medium. The cylinder extends around the center axis and forms an inner space in the cylinder. The cylinder includes a first opening and a second opening, which both communicate with one and the same of flow channels.

SUMMARY OF THE INVENTION

The object of the present invention is to overcome the problems mentioned above. More specifically, it is aimed at a spiral heat exchanger which permits an elegant layout of the conduits and pipes connected to the heat exchanger and which can be manufactured in an easy manner.

This object is achieved by the spiral heat exchanger initially defined, which is characterized in that the heat exchanger includes a first pipe, which is arranged to extend through the rear end into the inner space of the cylinder, wherein a first connection channel, communicating with the first flow channel via the first lateral opening, is formed within the first pipe and a second connection channel, communicating with the second flow channel via the second lateral opening, is formed in the inner space outside the first pipe.

By such a design, the layout of the pipes and conduits connected to the spiral heat exchanger may be less complicated than in the prior art design. The first pipe may be introduced as a separate unit or module into the cylinder after the winding of the sheets to form a spiral heat exchanger element. Consequently, the spiral heat exchanger element may be rotated to a desired position with respect to the outer ends of the flow channels before the introduction of the first pipe. The connection to the second connection channel may then be selected to extend in any desired direction. The first pipe may be located in an appropriate position in the inner space, for instance to facilitate discharge of sludge.

According an embodiment of the present invention, the first lateral opening is axially displaced from the second lateral opening. By separating the openings axially, it is possible to arrange the first pipe in any rotary position in relation to the cylinder and the spiral heat exchanger element.

According to a further embodiment of the present invention, the heat exchanger includes a separating member for dividing the inner space into a first part space including the first lateral opening and a second part space including the second lateral opening. The separating member may be attached to and extend around the first pipe. Moreover, the separating member may have an outer circumferential edge that is abutting an inner wall, which defines the inner space. In order to separate sealingly the first part space and the second part space from each other, the outer circumferential edge is welded to the inner wall.

According to a further embodiment of the present invention, the heat exchanger includes a second pipe, extending outwardly from the second part space and adapted to permit the second medium to pass through the second pipe.

According to a further embodiment of the present invention, the heat exchanger includes an enclosure provided at the rear end of the cylinder and arranged to close the second part space. Consequently, the first pipe will extend through the enclosure. Furthermore, the second pipe extends through the enclosure substantially radially outwardly from the enclosure with respect to the center axis. Such a second pipe may thus extend in any desired radial direction from the enclosure.

According to a further embodiment of the present invention, the heat exchanger includes a connection element including the first pipe. Advantageously, the connection element also includes the second pipe and the enclosure. Such a connection element may be manufactured as a separate unit or module, which is introduced into the cylinder after the winding of the sheets to form a spiral heat exchanger element. The connection element may easily be designed in such manner that it may be arbitrarily rotated in relation to the spiral heat exchanger element.

According to a further embodiment of the present invention, the heat exchanger includes a cover arranged to close the front end in an openable manner. The front end of the cylinder is thus accessible for cleaning, for instance.

According to a further embodiment of the present invention, the spiral heat exchanger includes a first outer connection member communicating with the first flow channel. Moreover, the spiral heat exchanger may include a second outer connection member communicating with the second flow channel. Advantageously, the heat exchanger may be adapted to be positioned in such a manner that the center axis extends substantially horizontally, wherein the first and second outer connection members extend substantially vertically.

According to a further embodiment of the present invention, the first pipe is arranged to extend substantially coaxially into the inner space. By such a design, it is ensured that the connection element may be rotated around the center axis to any rotary position in relation to the cylinder.

According to a further embodiment of the present invention, said flow channels extend substantially in parallel to each other, wherein each flow channel is adapted to permit the respective medium to flow in a substantially tangential direction with respect to the center axis.

BRIEF DESCRIPTION OF THE DRAWINGS

The present invention is now to be explained more closely by the description of various embodiments and with reference to the drawings attached hereto.

DETAILED DESCRIPTION OF VARIOUS EMBODIMENTS OF THE INVENTION

Figure 1:
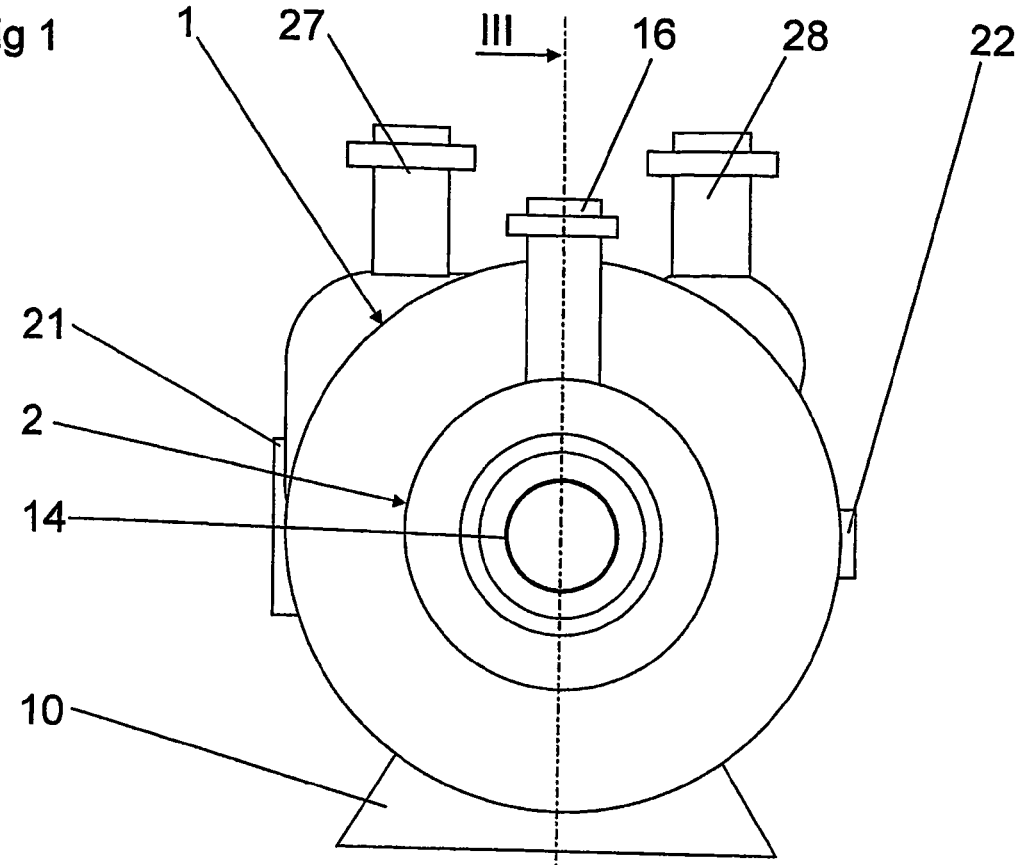
FIG. 1 discloses schematically a rear view of a spiral heat exchanger according to an embodiment of the present invention.
Figure 2:
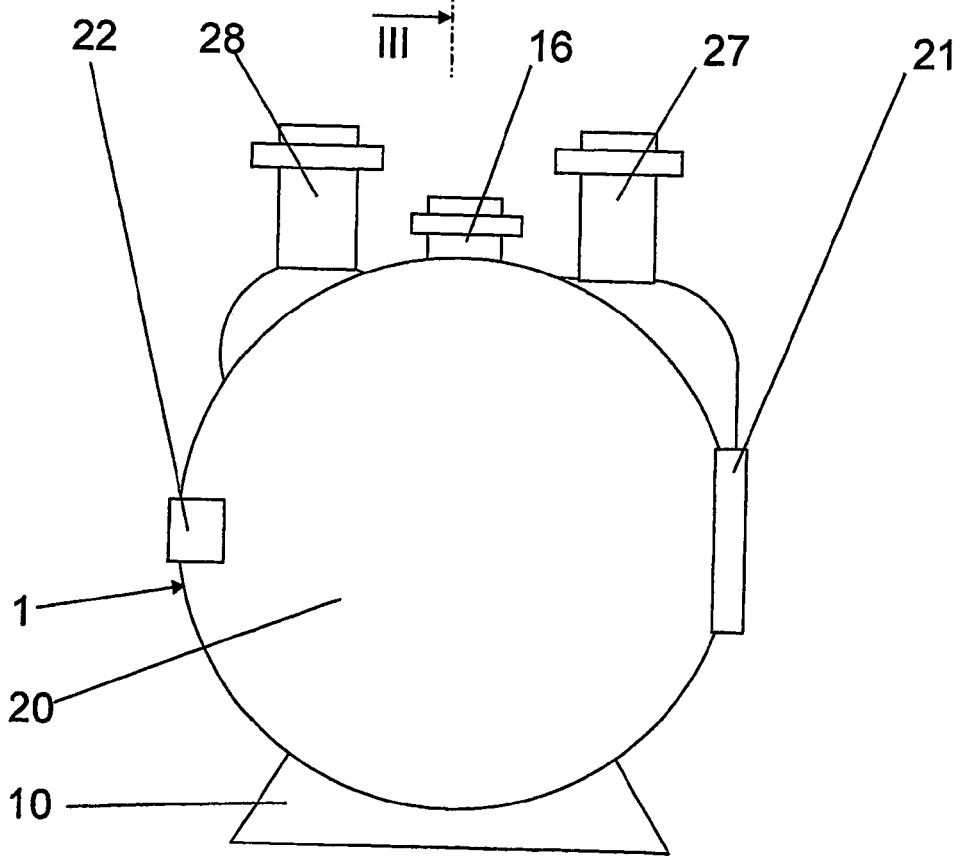
FIG. 2 discloses schematically a front view of the spiral heat exchanger in FIG. 1.
Figure 3:
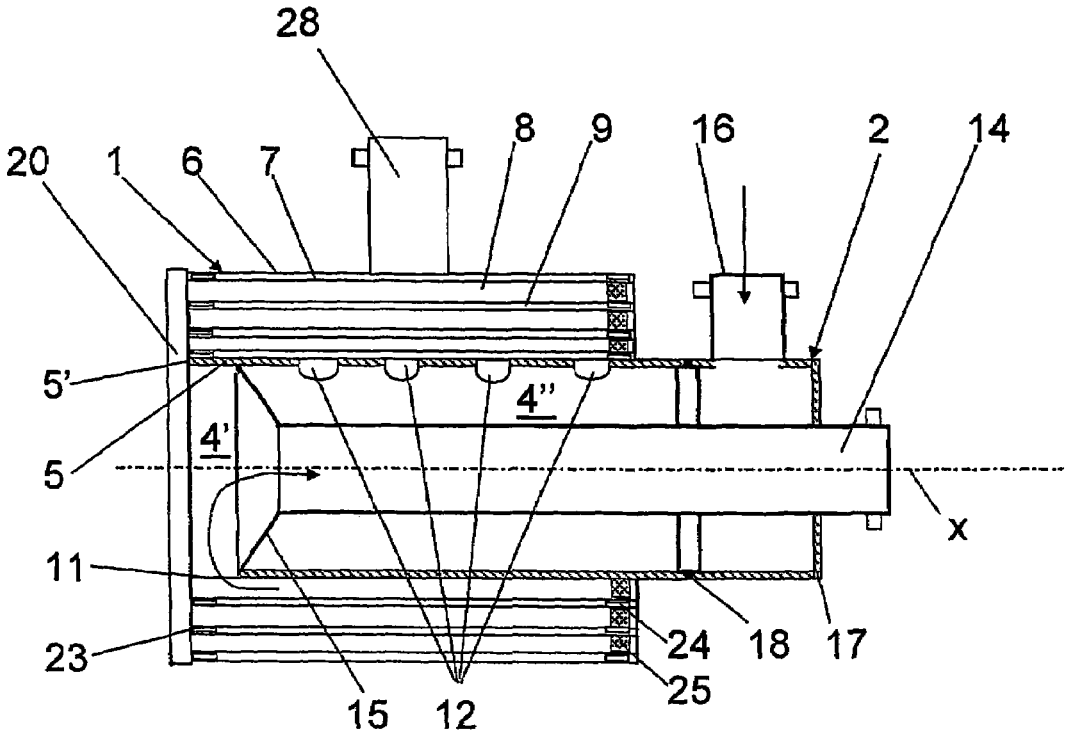
FIG. 3 discloses a sectional view through the spiral heat exchanger along the lines III-III in FIG. 1.

With reference to FIGS. 1-5, a spiral heat exchanger is disclosed. The spiral heat exchanger includes a spiral heat exchanger element 1, see FIG. 4, and a primary connection element 2, see FIG. 5. In the embodiments disclosed in FIGS. 1 to 6, the primary connection element 2 is designed as a separate unit to be mounted to the spiral heat exchanger element 1. It is to be noted that at least a part of the primary connection element 2, as an alternative, may be an integrated part of the spiral heat exchanger element 1 as explained below.

The spiral heat exchanger element 1 includes a central cylinder 5 and at least two spiral sheets 6 and 7, preferably of metal, such as stainless steel, carbon steel or titanium. The cylinder 5 has a substantially circular cylindrical shape. Each of the sheets 6, 7 has an inner end edge, which is welded to the outer surface of the cylinder 5. The cylinder 5 is rotated around a center axis x to wind the sheets 6, 7 in such a way that the sheets 6, 7 will extend from the cylinder 5 along a respective spiral-shaped path around the common center axis x. The sheets 6, 7 form a first spiral-shaped flow channel 8 for a first medium and a second spiral-shaped flow channel 9 for a second medium. The flow channels 8, 9 extend substantially in parallel to each other. In the embodiments disclosed, each of the flow channels 8, 9 is adapted to permit the respective medium to flow in a substantially tangential direction with respect to the center axis x. The spiral heat exchanger is adapted to be positioned in such a manner that the center axis x extends substantially horizontally by means of a support member 10, which is adapted to be positioned on the ground or any other substrate, and to support the spiral heat exchanger element 1.

In a preferred application of the spiral heat exchanger, the first medium transported through the first flow channel is sludge, whereas the second medium is water. In this case, the first flow channel 8 has a greater width than the second flow channel 9, see FIG. 3.

The cylinder 5 extends substantially concentrically around the center axis x and forms an inner space 4 within the cylinder 5. The cylinder 5 has a front end 5' and a rear end 5". The cylinder 5 includes a first lateral opening 11 enabling communication between the inner space 4 and the first flow channel 8, and a number of second lateral openings 12 enabling communication between the inner space 4 and the second flow channel 9. The first lateral opening 11 is located in the proximity of the front end 5', and axially displaced along the center axis x from the second lateral openings 12. The second lateral openings 12 are arranged along a line extending in parallel with the center axis.

The connection element 2 is a separate element to be mounted to the spiral heat exchanger element 1. The connection element 2 includes a first pipe 14, which is arranged to extend through the rear end 5" of the cylinder 5 into the inner space 4 of the cylinder 5. The first pipe 14 thus has an outer end outside the cylinder 5 and an inner end within the inner space 4 of the cylinder 5. The first pipe 14' has a substantially circular, cylindrical shape and extends, in the embodiment disclosed in FIGS. 1-5, substantially coaxially with the center axis x into the inner space 4.

The connection element 2 forms, within the first pipe 14, a first connection channel communicating with the first flow channel 8 via the first lateral opening 11, and, in the inner space 4 outside the first pipe 14, a second connection channel communicating with the second flow channel 9 via the second lateral openings 12. A separating member 15 is provided for dividing the inner space 4 into a first part space 4' including the first lateral opening 11 and forming the first connection channel, and a second part space 4" including the second lateral openings 12 and forming the second connection channel.

The separating member 15 is attached to the outer peripheral surface of the first pipe 14 at the inner end of the first pipe 14. The separating member 15 extends around the first pipe 14. The separating member 15 has an outer circumferential edge that in the embodiments disclosed is abutting an inner wall surface of the cylinder 5. Preferably, the outer circumferential edge is welded to the inner wall of the cylinder 5.

Furthermore, the connection element 2 includes a second pipe 16, extending outwardly from the second part space 5' and from the second connection channel. The second pipe 16 is arranged to permit the second medium to pass through the second pipe 16. The connection element 2 also includes an enclosure 17 provided at the rear end 5" of the cylinder 5. The enclosure 17 is arranged to close the cylinder 5, and in particular the second part space 4". The enclosure has a flat end wall 17', and a substantially circular cylindrical wall 17", see FIG. 5. The connection element 2 is welded to the cylinder 5 by a weld joint 18 extending along the rear end 5' of the cylinder 5 and along the end of the cylindrical wall 17". The second pipe 16 extends through the enclosure 17 substantially radially outwardly from the cylindrical wall 17" of the enclosure 17. In the embodiment disclosed the second pipe 16 extends substantially vertically, i.e. substantially perpendicularly with respect to the center axis x. Also the first pipe 14 extends through the enclosure 17, but through the end wall 17' of the enclosure 17.

As an alternative, the enclosure 17 could form an integrated part of the cylinder 5, wherein the primary connection element 2 substantially only includes the first pipe 14, which is introduced into the inner space 4 of the cylinder 5 via an opening in the flat end wall 17'. The separating member 15 is then attached and welded to the first pipe and the inner surface wall after the introduction of the first pipe 14 into the inner space 4.

The spiral heat exchanger includes a cover 20 arranged to close the front end 5' of the cylinder 5 and also to close laterally one or both of the flow channels 8, 9. In the embodiments disclosed, the first flow channel 8 is closed by the cover 20. The inner space 4 is thus defined by an inner wall including the inner wall surface of the cylinder 5, a substantially plane inner wall surface of the cover 20, and an inner wall surface of the enclosure 17. The cover 20 is openable, and attached to the spiral heat exchanger element 1 by a hinge 21. A locking device 22, schematically indicated, is arranged to permit locking of the cover 20 in the closed position. As appears form FIG. 3, the second flow channel 9 is laterally closed at the front side end by means of a spiral bar 23 arranged between the metal sheets 6, 7. Moreover, the second flow channel 9 is closed at the rear side end by means of a spiral bar 24 arranged between the metal sheets 6, 7. The first flow channel 8 is closed at the rear side end by means of a spiral bar 25 arranged between the metal sheets 6, 7. The bars 23 to 25 are arranged at the respective side ends in connection with the winding of the spiral heat exchanger element 1.

Furthermore, the spiral heat exchanger includes two secondary connection elements. The first secondary connection element forms a first outer connection member 27 communicating with the first flow channel 8. The second secondary connection element forms a second outer connection member 28 communicating with the second flow channel 9. The first outer connection member 27 and the second outer connection member 28 include a respective substantially cylindrical pipe. In the embodiment disclosed, the pipes extend substantially vertically, i.e. substantially perpendicularly to the center axis x.

In the preferred application mentioned above, the first pipe 14, i.e. the first connection channel, may form an outlet for the sludge. The second pipe 16 may form an inlet for the water. The first outer connection member 27 may form an inlet for the sludge, whereas the second outer connection member 28 may form an outlet for the water.

Figure 6:
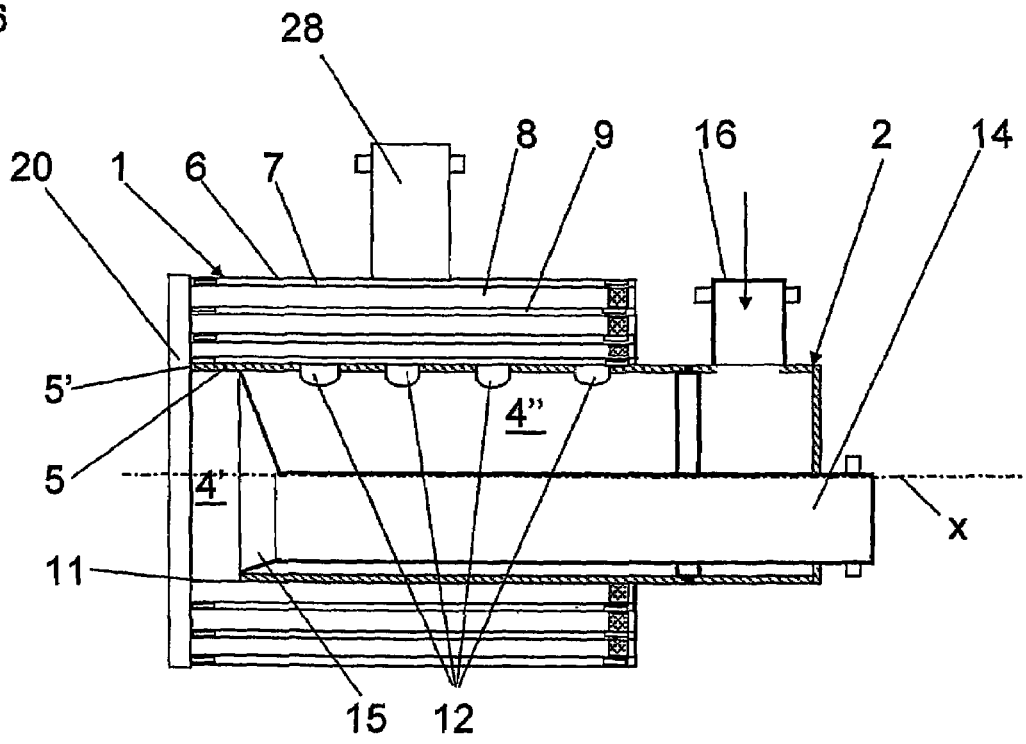
FIG. 6 discloses a sectional view through a spiral heat exchanger according to another embodiment of the present invention.
Figure 4:
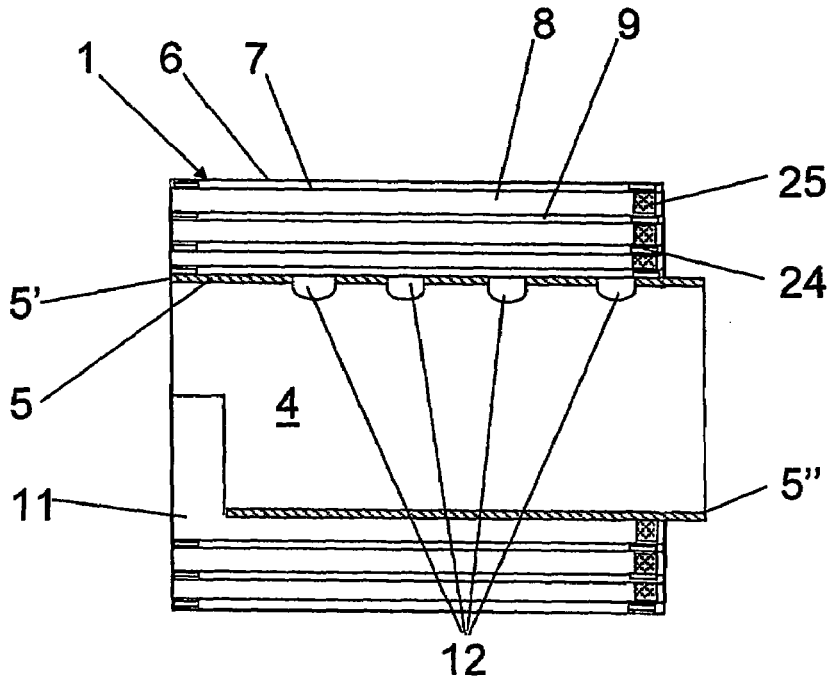
FIG. 4 discloses schematically a sectional view through a spiral heat exchanger element of the spiral heat exchanger in FIG. 1.
Figure 5:
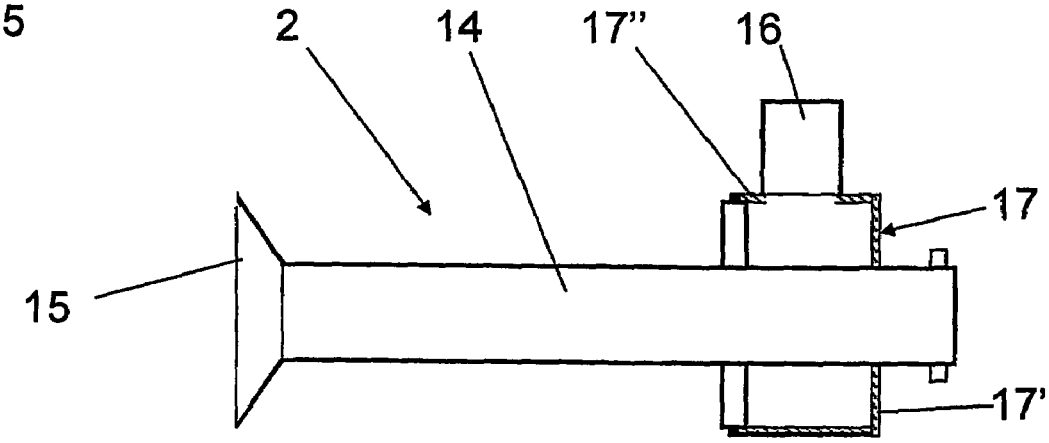
FIG. 5 discloses schematically a transversal section through a connection element of the spiral heat exchanger in FIG. 1.

FIG. 6 discloses a second embodiment, which merely differs from the first embodiment in that the first pipe 14 of the connection element 2 is eccentrically arranged in the inner space 4 of the cylinder 5.

The present invention is not limited to the embodiments disclosed and described herein but may be varied and modified within the scope of the following claims.

What is claimed is:

1. A spiral heat exchanger comprising a central cylinder (5) and at least two spiral sheets (6, 7) extending from the cylinder along a respective spiral-shaped path around a common center axis (x) and forming at least a first spiral-shaped flow channel (8) for a first medium and a second spiral-shaped flow channel (9) for a second medium, wherein the cylinder (5) extends around the center axis (x) and forms an inner space (4) within the cylinder, wherein the cylinder includes a front end (5'), a rear end (5"), at least a first lateral opening (11) communicating with the first flow channel (8) and at least a second lateral opening (12) communicating with the second flow channel (9), wherein the heat exchanger includes a first pipe (14), which is arranged to extend through the rear end (5") into the inner space of the cylinder (5), wherein a first connection channel, communicating with the first flow channel (8) via the first lateral opening (11), is formed within the first pipe (14) and a second connection channel, communicating with the second flow channel (9) via the second lateral opening (12), is formed in the inner space outside the first pipe (14), and wherein the first lateral opening (11) is axially displaced from the second lateral opening (12).

2. The heat exchanger according to claim 1, wherein the heat exchanger includes a separating member (15) for dividing the inner space into a first part space (4') including the first lateral opening (11) and a second part space (4") including the second lateral opening (12).

3. The heat exchanger according to claim 2, wherein the separating member (15) is attached to and extends around the first pipe (14).

4. The heat exchanger according to claim 3, wherein the separating member (15) has an outer circumferential edge that is abutting an inner wall of the cylinder, which defines the inner space (4).

5. The heat exchanger according to claim 4, wherein the outer circumferential edge is welded to the inner wall.

6. The heat exchanger according to claim 2, wherein the heat exchanger includes a second pipe (16), extending outwardly from the second part space and arranged to permit the second medium to pass through the second pipe (16).

7. The heat exchanger according to claim 2, wherein the heat exchanger includes an enclosure (17) provided at the rear end (5") of the cylinder and arranged to close the second part space (4").

8. The heat exchanger according to claim 7, wherein the second pipe (16) extends through the enclosure (17) substantially radially outwardly from the enclosure.

9. The heat exchanger according to claim 1, wherein the heat exchanger includes a connection element (2) including the first pipe.

10. The heat exchanger according to claim 9, wherein the connection element (2) also includes a second pipe (16) and an enclosure (17).

11. The heat exchanger according to claim 1, wherein the heat exchanger includes a cover (20) arranged to close the front end (5') in an openable manner.

12. The heat exchanger according to claim 1, wherein the heat exchanger includes a first outer connection member (27) communicating with the first flow channel (8).

13. The heat exchanger according to claim 12, wherein the heat exchanger includes a second outer connection member (28) communicating with the second flow channel (9).

14. The heat exchanger according to claim 13, wherein the heat exchanger is adapted to be positioned in such a manner that the center axis (x) extends substantially horizontally, and that the first and second outer connection members (27, 28) extend substantially vertically.

15. The heat exchanger according to claim 1, wherein the first pipe (14) is arranged to extend substantially coaxially into the inner space (4).

16. The heat exchanger according to claim 1, wherein the flow channels (8, 9) extend substantially in parallel to each other, and wherein each flow channel is adapted to permit the respective medium to flow in a substantially tangential direction with respect to the center axis (x).

* * * * *